United States Patent [19]

An

[11] 4,141,818

[45] Feb. 27, 1979

[54] METHOD OF COLLECTING OIL FROM CRUDE OIL RESIDUE

[76] Inventor: Jung B. An, #3-1 JungAng Dong, Busan, Rep. of Korea, 600

[21] Appl. No.: 836,496

[22] Filed: Sep. 26, 1977

[30] Foreign Application Priority Data

Jun. 23, 1977 [KR] Rep. of Korea ..... 1475

[51] Int. Cl.[2] ..... C10G 21/14

[52] U.S. Cl. ..... 208/177; 208/8; 208/290

[58] Field of Search ..... 208/298, 251 R, 39, 208/45, 22, 23, 177, 187, 8, 290

[56] References Cited

U.S. PATENT DOCUMENTS

| | | | |
|---|---|---|---|
| 2,783,188 | 2/1957 | Agoston | 208/45 |
| 2,871,181 | 1/1959 | Kulik | 208/8 |
| 3,013,961 | 12/1961 | Hemfort et al. | 208/251 R |
| 3,505,202 | 4/1970 | Nelson | 208/8 |
| 4,012,314 | 3/1977 | Goldberger et al. | 208/251 R |
| 4,021,335 | 5/1977 | Beaton | 208/251 R |
| 4,036,603 | 7/1977 | Bernet et al. | 208/39 |

*Primary Examiner*—George Crasanakis

*Attorney, Agent, or Firm*—Morse, Altman, Oates & Bello

[57] ABSTRACT

Oil is separated from impurities in crude oil residue by (1) mixing and agitating the oil residue with a solvent, such as naphtha, light oil or kerosene, (2) subjecting the mixture to a centrifugal separator to separate a solvent-oil mixture from the residue impurities. The structure of the centrifugal separator includes a rotating separator unit having a fine mesh wall and located within a heated, spaced cylindrical body.

6 Claims, 1 Drawing Figure

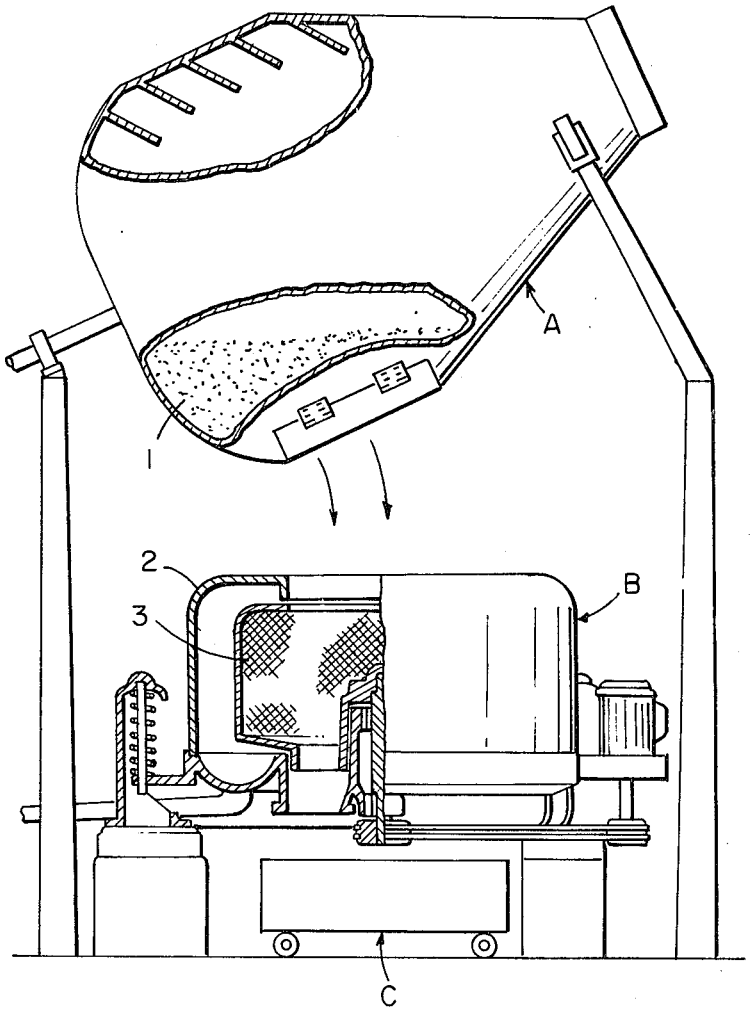
A
1
2
3
B
C

METHOD OF COLLECTING OIL FROM CRUDE OIL RESIDUE

BACKGROUND OF THE INVENTION

1. Field of the Invention

The present invention relates to a method of collecting oil from crude oil residue.

2. Description of the Prior Art

Generally, crude oil residue generates at the time when a crude oil tanker or a storage tank at an oil refining plant is cleaned, or when residual substances are removed from a general oil tank.

As is well known, crude oil is present in opening in lime stones or sand stones together with natural gases and is confined therein being covered by poreless rocks overlying the stones. Therefore, when an oil well is dug below the rocks, the oil is drawn up due to an internal pressure in the ground or pumped by a pumping system. The oil thus obtained is then transported through a pipe system to an oil refining plant where it is classified into several divisions according to the differences in boiling points by distillation. The classified oils are further divided and refined to be separated into petroleum ether (having boiling points ranging between 60° and 120° C., e.g. pentane and hexane), ligroin, light naphtha (having boiling points ranging between 60° and 120° C., e.g. hexane and heptane), gasoline (having boiling points ranging between 40° and 205° C.), kerosene (having boiling points ranging between 175° C. and 325° C.) and light oil (having a boiling point of higher than 273° C.) and, finally, lubricating oil is collected by vacuum distillation. As regards the rest, although some is utilized for asphalt, a large portion thereof is burned or merely disposed as waste as it is which often leads to a cause of public pollutions. Such crude oil residue mostly comprises sand, mud and rust but it nevertheless contains useful oils in no small quantities and it has long been desired to develop an effective method of collecting these oils to thereby meet the present day situation in which petroleum resources are scanty.

SUMMARY OF THE INVENTION

As a result of an assiduous study, the present inventor has found that in the case of separating oil from crude oil residue, the oil is better separated and collected in a state in which the residue is admixed with light oil or other mineral solvents and well agitated in a mixer prior to its subjection to a centrifugal separator, than otherwise. Further, the inventor has also found that a better result can be obtained when the outer cylindrical body of the centrifugal separator is preheated prior to its operation. Thus, it will be seen that with the use of the method of the present invention it becomes possible to utilize at low costs waste crude oil residue which has hitherto been a cause of trouble in the way of its disposal.

Accordingly, an object of the present invention is to provide a method of separating and collecting oil from crude oil residue.

Another object of the present invention is to provide a method of separating and collecting oil from crude oil residue in a simple manner, at low costs and in a way in which the crude oil residue is effectively reutilized.

BRIEF DESCRIPTION OF THE DRAWINGS

Illustrating by the FIGURE to show the originality of present invention definitely, the characteristic of present invention is shown well in the FIGURE.

The accompanying drawing is an illustrating FIGURE of the equipment showing the practicing example of present invention.

It contains a crude oil residue being in a state of low viscosity paste.

DETAILED DESCRIPTION OF THE PREFERRED EMBODIMENTS

The present invention will now be explained in detail with reference to the accompanying drawing showing, merely for illustrative purposes, a side view of a combination of a mixer and a centrifugal separator used in the present invention.

As shown in the drawing, a mixture 1 of crude oil residue and a mineral solvent selected from among naphtha, kerosene, light oil and gasoline is introduced into a mixer "A" which is capable of revolving three times per minutes. The mixing ratio of the crude oil residue to the mineral solvent is 1 : 0.1 to 100. The mixture is well agitated by the mixer "A" for ten minutes to become a viscous solution which is then introduced into a fine mesh 3 of a highly efficient separator "B". When the centrifugal separator "B" is operated at a high speed for about five minutes, the oil contained in the mixture 1 is separated from impurities such as sand, mud and rust and is collected in an oil cart "C" for transport. As a result of an actual experiment conducted by the present inventor, it was observed that when the mixture 1 of the crude oil residue and the mineral solvent was agitated in the mixer "A", the crude oil residue was crushed by the agitation blades of the mixer and also by shocks due to agitation and the mineral solvent soaked into the crushed residue while the oil contained in the sand, mud and rust gathered to become a viscous liquid. Further, when the liquid was introduced into the mesh 3 of the centrifugal separator "B" operating at a high speed of about 1,300 r.p.m. or higher, the dissolved crude oil residue was centrifugally separated outside the mesh 3 from the impurities remained within the latter. After investigation, it was found that little or no oil was contained in the remained impurities so that they could be disposed as waste as they were without any danger of causing public pollutions.

As described above, the method of the present invention is characterized in that crude oil residue is admixed with mineral solvents such as naphtha, kerosene and light oil prior to its subjection to a centrifugal separator. The advantages of the present invention are that useful petroleum contained in the crude oil residue can be separated and collected from the residue in a simple manner and at low costs and further that the final residue can be disposed as waste as it is without burning or other processes.

What is claimed is:

1. The method of separating oil from impurities in crude oil residue, comprising the steps of a. mixing and agitating said residue with a mineral solvent to an extent sufficient to crush said residue and soak said crushed residue with said solvent, and, b. centrifugally separating solvent and dissolved crude oil from said residue by rapidly rotating said crushed and soaked residue in a separator having a fine mesh wall, said separator being within a heated, spaced cylindrical body, c. said solvent and dissolved oil passing through said mesh wall upon rotation of said wall and collecting in said heated, spaced body, said residue impurities being retained within said mesh wall and removed separately therefrom.

2. A method of collecting oil from crude oil residue as claimed in claim 1 in which the mixing ratio of said crude oil residue to said mineral solvent is 1:0.1 to 100.

3. A method of collecting oil from crude oil residue as claimed in claim 1 in which said mineral solvent is naphtha.

4. A method of collecting oil from crude oil residue as claimed in claim 1 in which said mineral solvent is light oil.

5. A method of collecting oil from crude oil residue as claimed in claim 1 in which said mineral solvent is kerosene.

6. A method of collecting oil from crude oil residue as claimed in claim 1 in which said cylindrical body of the centrifugal separator is preheated before said crude oil residue is introduced thereinto.

* * * * *